US005156209A

United States Patent [19]

McHardy

[11] Patent Number: 5,156,209

[45] Date of Patent: Oct. 20, 1992

[54] ANTI BLOW-OUT CONTROL APPARATUS

[75] Inventor: Colin McHardy, Aberdeen, Scotland

[73] Assignee: Petroline Wireline Services Ltd., Scotland

[21] Appl. No.: 659,093

[22] Filed: Feb. 22, 1991

[30] Foreign Application Priority Data

Feb. 22, 1990 [GB] United Kingdom ..... 9004059

[51] Int. Cl.[5] ..... E21B 34/06

[52] U.S. Cl. ..... 166/324; 166/332

[58] Field of Search ..... 166/72, 373, 319, 324, 166/332, 181

[56] References Cited

U.S. PATENT DOCUMENTS 3,151,681 10/1964 Cochran ..... 166/332
3,750,751 8/1973 Mott ..... 166/72 X
4,460,040 7/1984 Bowyer ..... 166/324 X

*Primary Examiner*—Terry Lee Melius

*Attorney, Agent, or Firm*—Lalos & Keegan

[57] ABSTRACT

In a downhole assembly (1) including an outer casing or mandrel (2), an axially movable prong (11) in the mandrel, and means for equalizing pressure within the mandrel (1) comprising a fluid duct (7) communicating the interior of the mandrel with the outside and a control member (or melon) (8) movable by the prong to control fluid flow via said duct (7); there is provided apparatus for controlling movement of the prong (11) comprising radially movable arrester dogs (14) engagable with a rib (20) on the prong (11) and an annular piston device (15) located in a housing (16) adapted for operative movement of the dogs (14). In particular housing zones on either side of the piston device (15) are maintained at tool external and mandrel internal pressure respectively whereby the piston device (11) is moved to lock the prong (11) when there is a pressure imbalance but free the prong (11) when pressure equilibrium is reached.

10 Claims, 2 Drawing Sheets

ANTI BLOW-OUT CONTROL APPARATUS

The present invention relates to anti blow-out control apparatus for use with downhole assemblies, especially downhole assemblies provided with a pressure equalisation device for equalising pressure within the assembly with that external of the assembly. More especially the control apparatus serves to control the operation of a pulling tool used for retrieval of the downhole assembly.

In oil drilling, downhole assemblies serve to place a running tool appropriately in the hole. To this end the assembly comprises an outer mandrel arrangement carrying an appropriate tool at its lower end, and including a lock mechanism and a drive pinned to the mandrel to drive the mandrel arrangement. After an appropriate operational period the desirability will arise to release the lock mechanism and withdraw the assembly with the tool, and to achieve this operation a pulling tool is offered to the mandrel arrangement with the purpose of releasing the lock mechanism and latching to the assembly for retrieval. However if this release and latching operation is carried out when the pressure external of the assembly, especially from below the assembly, is considerably greater than the pressure within the assembly a dangerous situation arises with the possibility of a blow out in the hole.

SUMMARY OF THE INVENTION

It is an object of the present invention to provide control apparatus for use with a downhole assembly which obviates or mitigates the above problem.

According to the present invention there is provided control apparatus for use with a pulling tool in a downhole assembly provided with pressure equalising means including an equalising prong operatively engagable by the pulling tool, said control apparatus comprising an arrester means for the prong; a receiving member to positively locate the arrester means and including slot means in which the arrester means is movable, an annular piston located in a housing so as to be movable over said receiving member, said piston being movable in response to the pressure differential between internal pressure within the assembly and pressure external of the assembly; said piston including actuating means positionable in a first position to move said arrester means to arrest the prong in an arrested position when the external pressure exceeds the assembly internal pressure; the pressure equalizing means, in said arrested position, causing the internal pressure to move towards equality with the external pressure whereby the piston moves to place the actuating means in a second position freeing the arrester means to permit continued movement of the prong and the pulling tool for operative engagement of the tool with the assembly.

Preferably, one side of the piston facing a first end of the housing is exposed to external pressure while the other side of the piston is exposed to the internal pressure, and spring means are provided biasing the piston towards said first end of the housing.

Preferably the arrester means comprises a radially movable annular assembly which is moved radially inwards by said piston to the prong arresting position.

Preferably the annular assembly comprises an annular series of dogs.

Preferably the arrester means are such as to allow fluid movement along the prong for equalisation of pressure on opposed sides of the piston.

Preferably further the piston provides cam surfaces for radial movement of the arrester means.

BRIEF DESCRIPTION OF THE DRAWINGS

An embodiment of the present invention will now be described by way of example with reference to the accompanying drawings wherein.

DETAILED DISCUSSION

Figure 1:
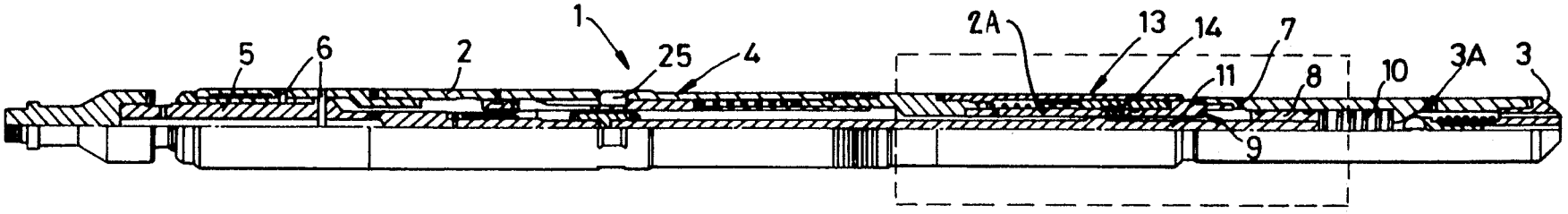
FIG. 1 shows successive sections of a downhole assembly in the form of a hanger plug, with a running tool in place, and including a pulling tool control apparatus according to the present invention.

Referring to the drawings, a downhole assembly 1 defining a hanger plug comprises a mandrel arrangement 2 for a tool 3 at the lower end and including a locking device 4. In FIG. 1A/B, the assembly 1 is shown with a drive 5 and running tool 3 in place, the drive 5 being connected to the mandrel arrangement by pins 6. A check valve 3A controls fluid flow at the lower end of the assembly. The mandrel 2 includes apertures 7 whereby pressure within the assembly can be equalised with the external pressure, and especially with the pressure below the assembly 1. Fluid flow through the apertures 7 is controlled by an annular control member 8 known in the art as a melon, the melon 8 being forced towards a seating 9 by means of compression spring 10 for closure of the apertures 7. An equalising prong 11 is movable to push the melon 8 to the position shown in FIGS. 1/2 clear of the apertures 7.

Figure 4:
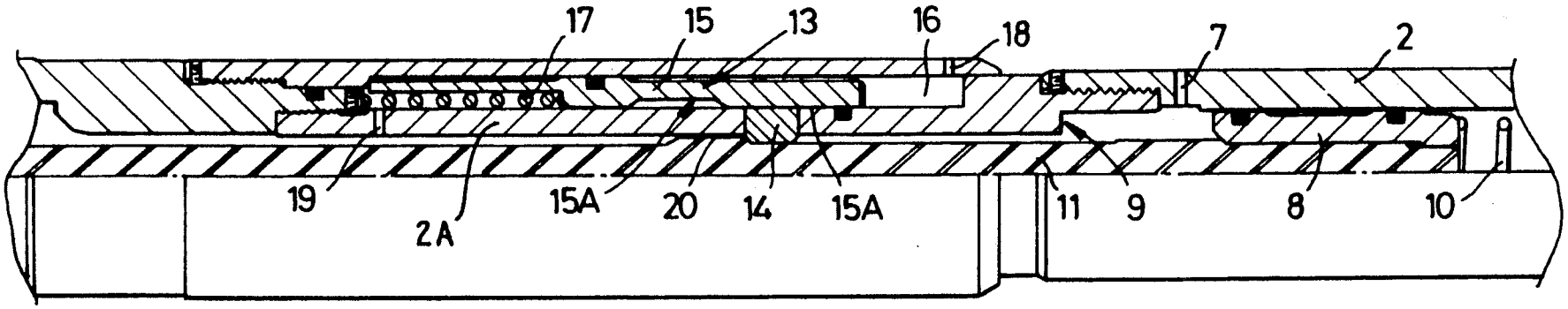

A control apparatus 12 serves to control the movement of the prong 11, and comprises a pressure sensing device 13 responsive to the differential between the internal and external pressures of the assembly 1, and an arrester means in the form of an annular series of radially movable dogs 14 positively located in a receiving member 2A of the mandrel and actuable by the pressure sensing device 13. The device 13 comprises a pressure sensing piston 15 located in a housing 16 and urged towards the outer end of the housing 16 by a compression spring 17, the face of the piston 15 facing said outer end of the housing being exposed to external pressure by means of apertures 18 while the opposed face of the piston 15 is exposed to internal pressure via apertures 19. Further, the piston 15 includes a cam surface 15A for radial movement of the dogs 14. The cam surfaces 15A moves the dogs 14 radially inwards to the arresting position shown in FIG. 4 restricting the bore of the mandrel 2 and in particular engaging rib formation 20 on the prong 11 for prong arrestment.

Figure 2:
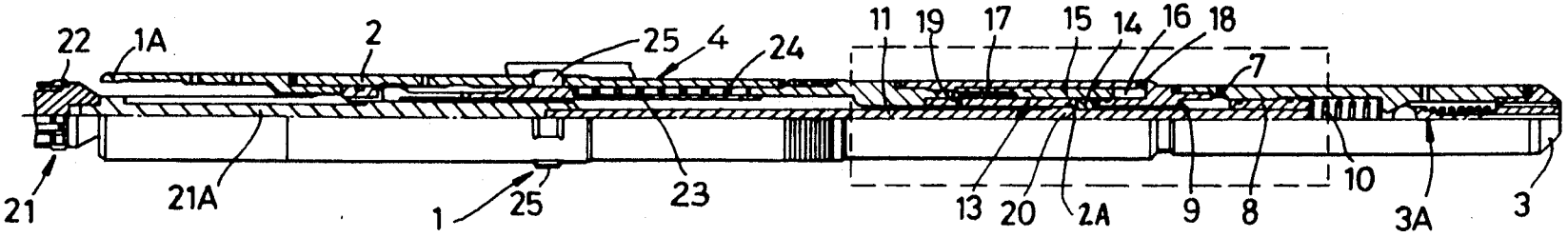
FIG. 2 shows the downhole assembly with the pulling tool located prior to lock release and latching.
Figure 3:
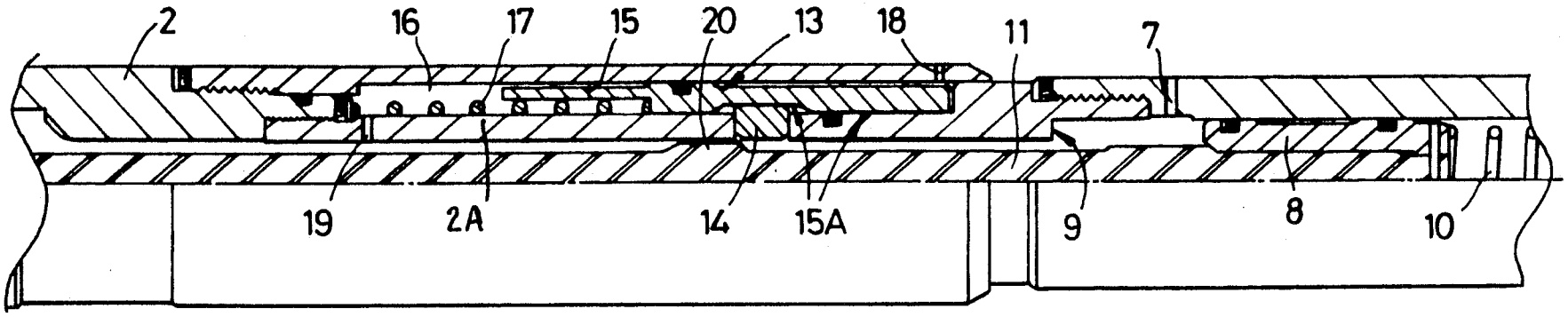
FIGS. 3 and 4 show the control apparatus of FIGS. 1 and 2 as indicated in the dashed boxes, to a larger scale.

FIG. 2 shows a pulling tool 21 being presented to the assembly 1 for the purpose of releasing the lock mechanism and latching to the assembly for assembly withdrawal. The pulling tool 21 includes a probe part 21A coupled to the prong 11 and latching leaves 22 for latching to the mouth 1A of the assembly 1. In FIG. 2 inner mandrel part 23 is urged to the left by spring 24 for placement of a locking member 25 in a locking position.

Operation of the Control Apparatus in Respect of the Release and Pulling Tool

Any pressure differential from below relative to internal pressure within the assembly 1 will cause the pressure sensing piston 15 of the control device 13 to move up against the force of spring 17 and hence the dogs 14 will be expanded inwards by the cam surface 15A thereby restricting the bore of mandrel 2 and arresting the prong 11 via rib formation 20 thereby preventing full access by the equalising prong 11.

However the prong 11 is permitted to have sufficient movement to shift the melon 8 off the seat 9 to the pressure equalising position clear of apertures 7, but will not allow full access by the probe 21A serving to unlock the inner mandrel of the locking device, as can be seen in FIG. 2. The dogs 14 and rib 20 permit fluid flow to the apertures 19 in the FIG. 4 position, and when the pressure is equalised above and below the plug the piston 15 will be returned to its original position by the spring 17, allowing the dogs 14 to retract and allowing full access by the equalising prong 11 and by the probe 21A. In this position, the inner mandrel part 23 can be moved down by the probe 21A allowing the locking mechanism to unlock and the assembly 1 to be retrieved.

The above arrangement ensures that should any excess pressure be present below the plug assembly, the assembly cannot be unlocked inadvertently and therefore will not be blown up the hole. However should excess pressure be present it is possible to equalise the pressure by the pressure equalising arrangement of the assembly, and as this equalising arrangement does not directly affect the lock mechanism the arrangement cannot prevent the lock mechanism being retrieved should it malfunction.

Modifications are of course possible. In particular, equalisation of internal/external pressure could be achieved by some other means than the spring loader melon 8/10 shown, and another fluid control device than the check valve 3A at the bottom end could be used such as for example a pump open plug.

I claim:

1. A control apparatus for use with a pulling tool in a downhole assembly provided with a pressure equalizing means including an equalizing prong operatively engageable by the pulling tool, said control apparatus comprising:

an arrester means for the prong;

a receiving member to positively locate the arrester means and including a slot means in which the arrester means is movable;

an annular piston located in a housing so as to be movable over said receiving member, said piston being movable in response to a pressure differential between an internal pressure within the assembly and a pressure external of the assembly, said piston including an actuating means positionable in a first position to move said arrester means to arrest the prong in an arrested position when the external pressure exceeds the assembly internal pressure;

the equalizing prong, in said arrested position, causing the internal pressure to move towards equality with the external pressure whereby the piston moves to place the actuating means in a second position freeing the arrester means to permit movement of the prong and the pulling tool for operative engagement of the tool with the assembly.

2. The control apparatus as claimed in claim 1, wherein one side of the piston facing a first end of the housing is exposed to the external pressure, the control apparatus further comprising a means for biasing the piston towards said first end of the housing.

3. The control apparatus as claimed in claim 1, wherein the arrester means comprises a radially movable annular assembly which is moved radially inward by said actuating means to the prong arresting position.

4. The control apparatus as claimed in claim 3, wherein the annular assembly comprises an annular series of dogs.

5. The control apparatus as claimed in claim 1, wherein the arrester means is such as to allow fluid movement along the prong for equalization of pressure on opposed sides of the piston.

6. The control apparatus as claimed in claim 1, wherein said actuating means of the piston comprises cam surfaces for radial movement of the arrester means.

7. The control apparatus as claimed in claim 1, wherein the tool includes a probe, and the equalizing prong is operatively engageable by the probe.

8. The control apparatus as claimed in claim 1, wherein the arrester means is adapted to engage with an annular shoulder on the prong to arrest the prong.

9. The control apparatus as claimed in claim 1, wherein said housing is defined by overlapping portions of a tool casing.

10. The control apparatus as claimed in claim 1, wherein said overlapping portions form radial passages for fluid flow to said one end and to said other end of the housing respectively.

* * * * *